US007813519B2

(12) United States Patent
Kargus, IV

(10) Patent No.: US 7,813,519 B2
(45) Date of Patent: Oct. 12, 2010

(54) MICROPHONE APPARATUS WITH INCREASED DIRECTIVITY

(75) Inventor: Walter A. Kargus, IV, Livonia, MI (US)

(73) Assignee: General Motors LLC, Detroit, MI (US)

( * ) Notice: Subject to any disclaimer, the term of this patent is extended or adjusted under 35 U.S.C. 154(b) by 1145 days.

(21) Appl. No.: 11/345,967

(22) Filed: Feb. 2, 2006

(65) Prior Publication Data

US 2007/0177752 A1 Aug. 2, 2007

(51) Int. Cl.
*H04R 25/00* (2006.01)

(52) U.S. Cl. ..... 381/356; 381/337; 381/338; 381/358

(58) Field of Classification Search ..... 381/337–343, 381/355–358, 360, 369, 179
See application file for complete search history.

(56) References Cited

U.S. PATENT DOCUMENTS

| | | | | |
|---|---|---|---|---|
| 2,228,886 | A * | 1/1941 | Olson | 181/158 |
| 2,921,993 | A * | 1/1960 | Beaverson | 381/357 |
| 3,856,992 | A | 12/1974 | Cooper | |
| 5,511,130 | A * | 4/1996 | Bartlett et al. | 381/170 |
| 5,808,243 | A | 9/1998 | McCormick et al. | |
| 5,848,172 | A * | 12/1998 | Allen et al. | 381/356 |
| 5,862,240 | A * | 1/1999 | Ohkubo et al. | 381/356 |
| 6,009,183 | A | 12/1999 | Taenzer et al. | |
| 6,026,082 | A | 2/2000 | Astrin | |
| 6,308,074 | B1 | 10/2001 | Chandra et al. | |
| 6,400,321 | B1 | 6/2002 | Fenwik et al. | |
| 6,445,799 | B1 | 9/2002 | Taenzer et al. | |
| 6,496,149 | B1 | 12/2002 | Birnbaum et al. | |
| 6,639,990 | B1 | 10/2003 | Astrin et al. | |
| 6,700,985 | B1 | 3/2004 | Taenzer et al. | |
| 6,867,738 | B2 | 3/2005 | Birnbaum et al. | |
| 7,369,664 | B2 | 5/2008 | Kargus IV et al. | |
| 7,454,352 | B2 | 11/2008 | Bicego et al. | |
| 7,526,284 | B2 | 4/2009 | Gryc | |
| 2003/0117323 | A1 | 6/2003 | Birnbaum et al. | |

(Continued)

OTHER PUBLICATIONS

Earlite™ 1100/Step 1100 Bluetooth Earpiece, http://www.stepcommunications.com/products/earlite 1100.htm.

(Continued)

*Primary Examiner*—Suhan Ni
(74) *Attorney, Agent, or Firm*—Anthony Luke Simon; Reising Ethington P.C.

(57) ABSTRACT

A microphone assembly includes a housing including at least one first tube in communication with at least one first cavity, at least one second tube in communication with at least one second cavity, one third tube in communication with at least one third cavity, and at least one microphone element separating the first, second and third cavities, wherein sound waves are received in the first, second, and third tubes and directed into the cavities and received by the microphone element. A method for converting sound waves into an electrical signal includes receiving the sound waves through at least three tube openings and directing the received sound waves along tube pathways into at least a first, second, and third cavity to a microphone separating the first, second, and third cavity. The method further includes converting the received sound waves into an electrical signal with the microphone.

8 Claims, 8 Drawing Sheets

U.S. PATENT DOCUMENTS

| | | | |
|---|---|---|---|
| 2003/0156722 | A1 | 8/2003 | Taenzer |
| 2004/0107097 | A1 | 6/2004 | Lenane et al. |
| 2004/0209653 | A1 | 10/2004 | Chandhok |
| 2004/0235530 | A1 | 11/2004 | Arun |
| 2005/0049859 | A1 | 3/2005 | Arun |
| 2005/0187763 | A1 | 8/2005 | Arun |
| 2006/0074651 | A1 | 4/2006 | Arun |
| 2006/0135215 | A1 | 6/2006 | Chengalvarayan et al. |
| 2007/0136063 | A1 | 6/2007 | Grost et al. |
| 2007/0136069 | A1 | 6/2007 | Veliu et al. |
| 2007/0174055 | A1 | 7/2007 | Chengalvarayan et al. |
| 2007/0211880 | A1 | 9/2007 | Ross et al. |
| 2008/0118080 | A1 | 5/2008 | Gratke et al. |

OTHER PUBLICATIONS

Step 1150™ Bluetooth® Wireless Headset, http://www.stepcommunications.com/products/step1150.htm.

* cited by examiner

MICROPHONE APPARATUS WITH INCREASED DIRECTIVITY

FIELD OF THE INVENTION

The present invention generally relates to microphones.

BACKGROUND OF THE INVENTION

Every microphone system has a directivity pattern indicative of its response based on the location of a sound source. Directivity patterns include, for example, cardioid and hypercardioid. Microphones can be customized to feature omnidirectional, bidirectional and unidirectional directivity. However, microphones featuring a rear lobe of directivity effectively reduces microphone efficiency and directional performance.

FIG. 1 illustrates the directivity patterns for a prior art unidirectional microphone. The results can be obtained using omnidirectional microphone elements and a bidirectional element, or by using a modified bidirectional microphone. Each result, however, results in a Directivity Index ("DI") of less than 6 decibels (dB). As used throughout this disclosure, the term DI refers to a measurement of the resistance to diffuse noise by a microphone element. The greater the DI, the greater the microphone element resists diffuse noise, i.e., the less diffuse noise is 'picked up' or received by the microphone element. Another effect of increasing the DI for a microphone is a resulting increase in the acceptable distance between microphone and sound source while maintaining a constant signal level.

For example, a current microphone in use has a DI of 5 dB. This microphone works best within about 16 inches of the sound source. Increasing the DI to 9 dB would increase the microphone range to about 22.5 inches.

Prior solutions to increase the DI of microphones have required use of either expensive equipment, such as parabolic arrays, or sizable equipment inappropriate for use in space-limited applications such as a mobile vehicle.

The present invention overcomes these disadvantages and advances the state of the art.

SUMMARY OF THE INVENTION

One aspect of the present invention provides a microphone assembly including a housing, including at least one first tube in communication with at least one first cavity, at least one second tube in communication with at least one second cavity, and at least one third tube in communication with at least one third cavity. The assembly further includes at least one microphone element separating the first, second and third cavities, wherein sound waves are received in the first, second and third tubes and directed into the cavities and received by the microphone element.

Another aspect of the invention provides a method for converting sound waves into an electrical signal including receiving the sound waves through at least three tube openings and directing the received sound waves along tube pathways into at least a first, second, and third cavity to a microphone separating the first, second, and third cavity. The method further includes converting the received sound waves into an electrical signal with the microphone.

A third aspect of the invention provides a system for converting sound waves into an electrical signal including means for receiving the sound waves through at least three tube openings and means for directing the received sound waves along tube pathways into at least a first, second, and third cavity to a microphone separating the first, second, and third cavity. The system further includes means for converting the received sound waves into an electrical signal with the microphone.

The aforementioned and other features and advantages of the invention will become further apparent from the following detailed description of the presently preferred embodiments, read in conjunction with the accompanying drawings. The detailed description and drawings are merely illustrative of the invention rather than limiting the scope of the invention being defined by the appended claims and equivalents thereof.

DETAILED DESCRIPTION OF THE PREFERRED EMBODIMENTS

Figure 1:
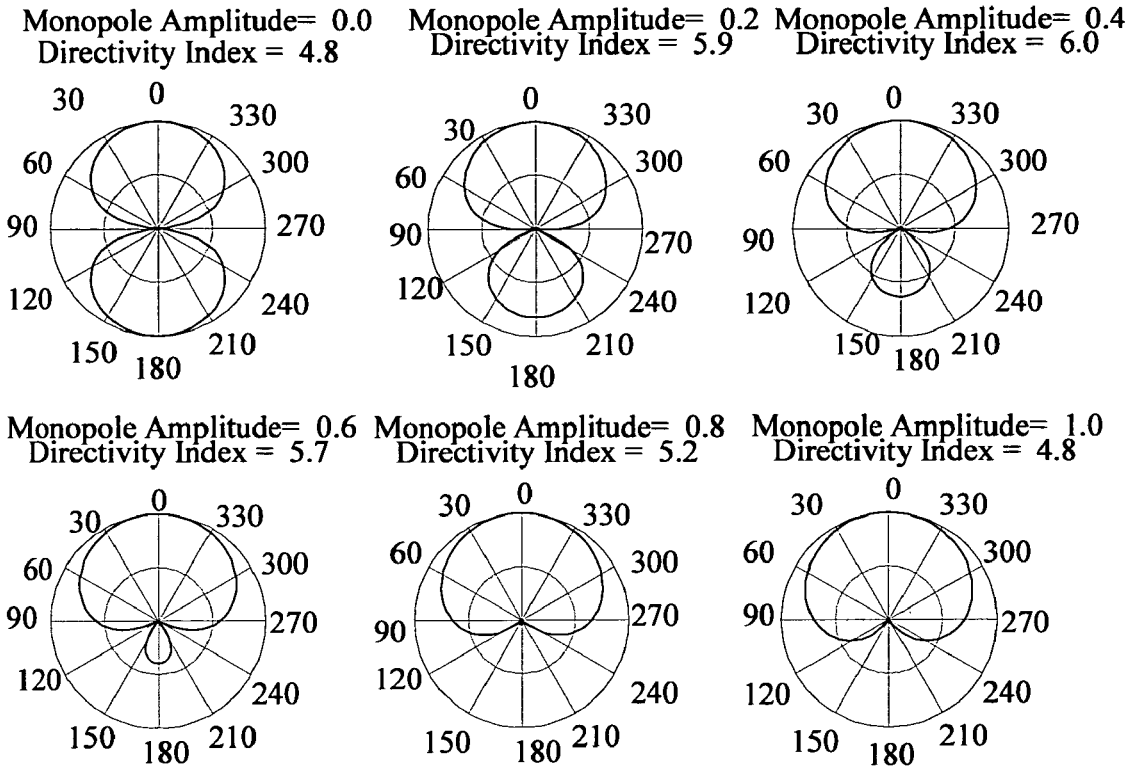
FIG. 1 PRIOR ART
FIG. 1 illustrates directivity and monopole amplitude for prior art microphones.
Figure 2A:
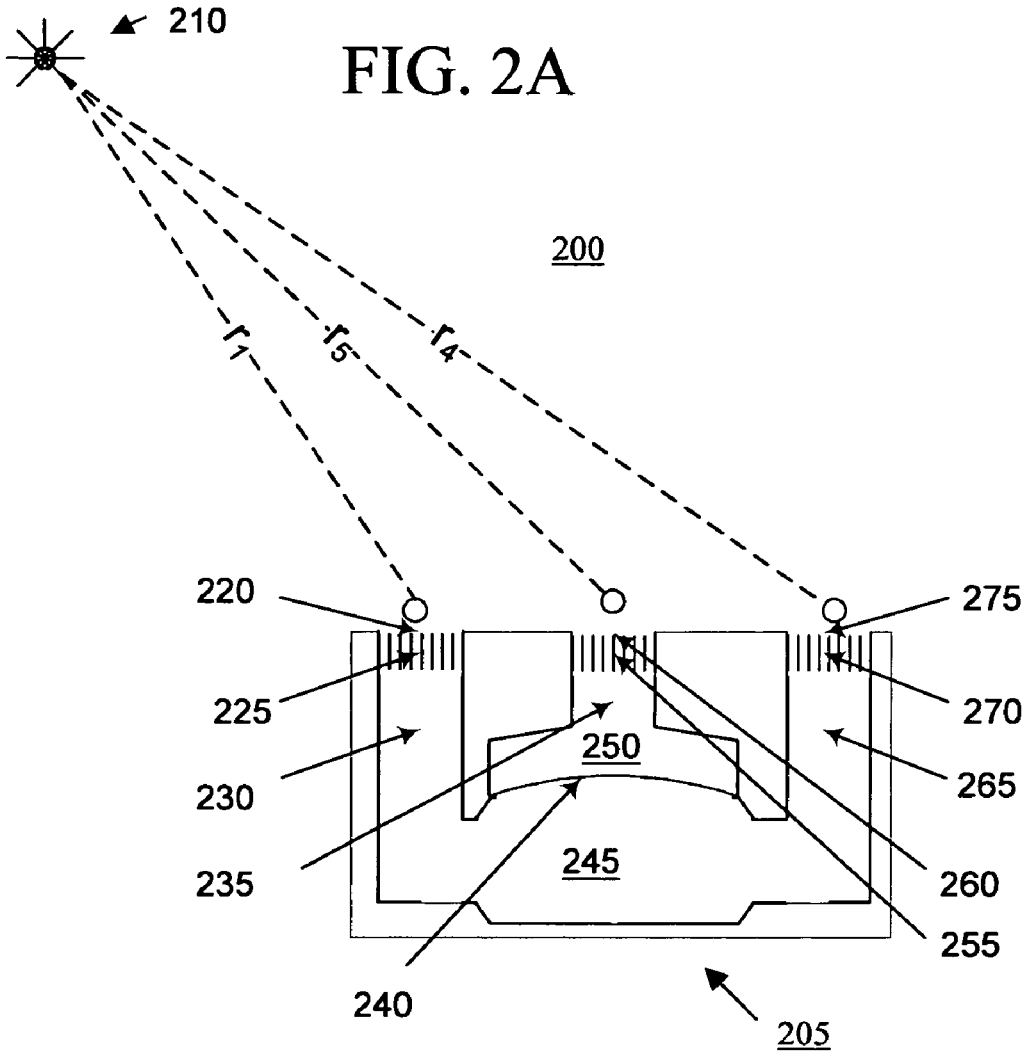
FIG. 2A illustrates one embodiment of a microphone assembly in accordance with one aspect of the invention.

FIG. 2A illustrates, in a side cross sectional view, one embodiment of a microphone assembly 200. Microphone assembly 200 receives sound waves r1, r4, and r5, from sound source 210.

Microphone assembly 200 includes a housing 205 including first tube 230, second tube 235, and third tube 265. First tube 230 is in communication with a first opening 220. In one embodiment, an acoustic resistor 225 is disposed within first tube 230. In one embodiment, acoustic resistor 225 is disposed near first opening 220.

Second tube 235 is in communication with second opening 260. In one embodiment, an acoustic resistor 255 is disposed within second tube 235. In one embodiment, acoustic resistor 255 is disposed near second opening 260. Third tube 265 is in communication with third opening 275. In one embodiment, an acoustic resistor 270 is disposed within third tube 265. In one embodiment, acoustic resistor 270 is disposed near third opening 275.

First tube 230 and third tube 265 are also in communication with first cavity 245. Second tube 235 is also in communication with second cavity 250. Microphone element 240 separates the first cavity 245 and second cavity 250. Microphone element 240 is a bidirectional microphone in one embodiment. Not shown in FIG. 2 is an electronic circuit in electrical communication with the microphone element 240.

Sound waves r1, r4, and r5 emitted from sound source 210 travel through the ambient air between sound source 210 and housing 205. Those of ordinary skill in the art recognize that sound waves can travel in other directions as well, but sound waves that are not directed at the housing 205 do not affect operation of the microphone assemblies disclosed herein. At least a portion of the sound waves are received in first, second, and third tubes 230, 235, 265 via first, second, and third openings 220, 260, 275. Received sound waves are directed through the first, second, and third tubes 230, 235, 265 to the first and second cavities 245, 250 where the sound waves interact with the microphone element 240. The interaction of sound waves with the microphone element results in the generation of electrical signals by the microphone element.

Figure 2B:
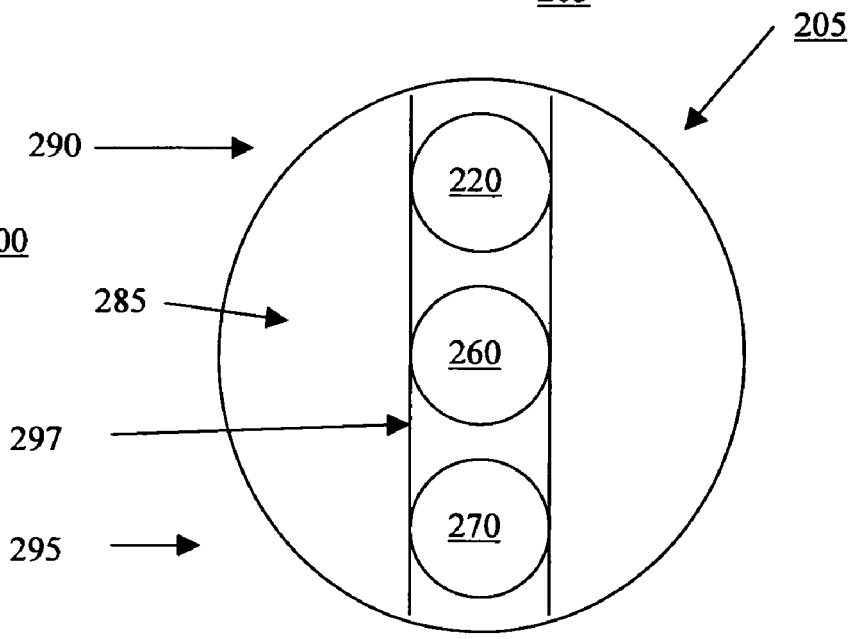
FIG. 2B illustrates a top view of the microphone assembly of FIG. 2A in accordance with one aspect of the invention.

FIG. 2B illustrates a top view of the microphone assembly depicted in FIG. 2A. As shown in FIG. 2B, microphone assembly housing 205 includes a sound reception face 285 including a first end 290 and a second end 295, the first end opposed to the second end. First opening 220 is located near first end 290 and third opening 270 is located near second end 295. The first, second, and third openings 220, 260, and 270 define a straight line 295 along the sound reception face, in one embodiment. Other embodiments of the invention include alternate arrangements of a plurality of openings on a sound reception face, such as opposing, quincunx, or others.

Figure 3:
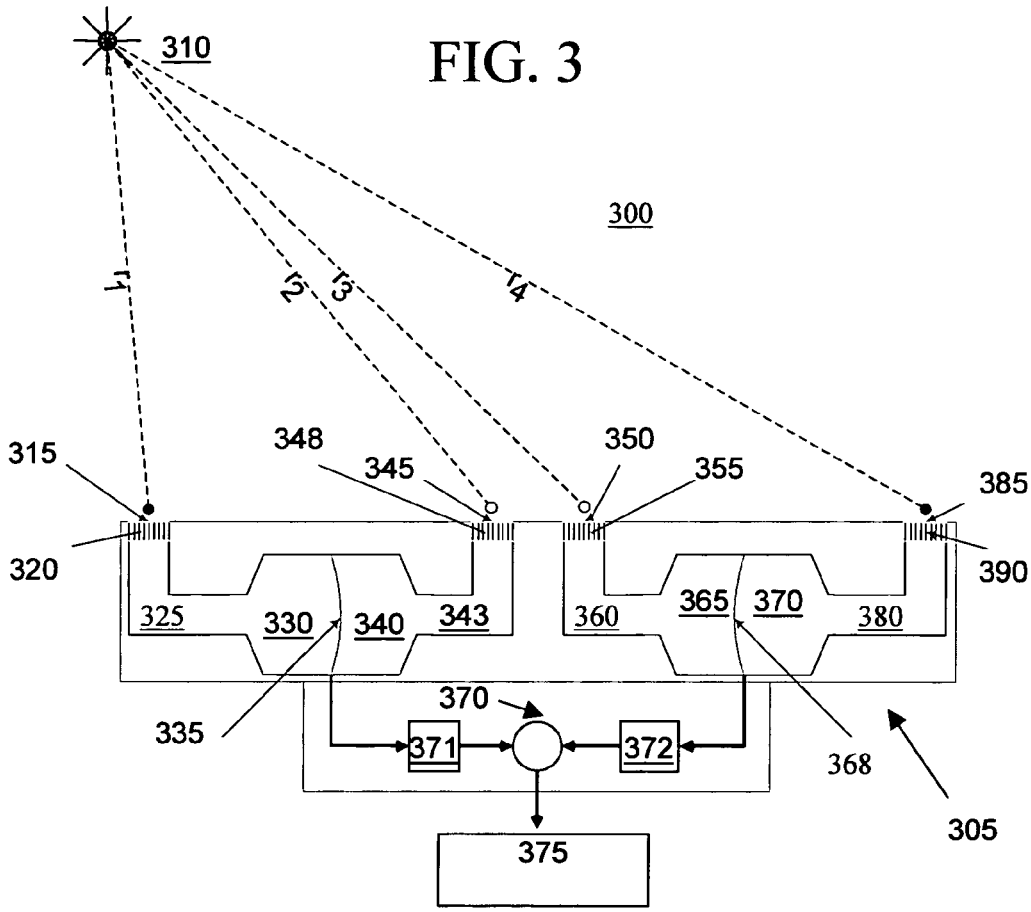
FIG. 3 illustrates one embodiment of a microphone assembly in accordance with one aspect of the invention.

FIG. 3 illustrates another embodiment of a microphone apparatus 300 in accordance with an aspect of the invention. Sound source 310 generates sound waves r1, r2, r3, and r4. Apparatus 300 includes a housing 305 including first opening 315, second opening 345, third opening 350, and fourth opening 385. First opening 315 is in communication with first tube 325, and first tube 325 is in communication with first cavity 330. Second opening 345 is in communication with second tube 343, and second tube 343 is in communication with second cavity 340. In one embodiment, acoustic resistor 320 is disposed within first tube 325. In one embodiment, acoustic resistor 320 is disposed near first opening 315. In one embodiment, acoustic resistor 348 is disposed within first tube 343. In one embodiment, acoustic resistor 348 is disposed near first opening 345.

Third opening 350 is in communication with third tube 360, and third tube 360 is in communication with third cavity 365. Fourth opening 385 is in communication with fourth tube 380, and fourth tube 380 is in communication with fourth cavity 370. In one embodiment, acoustic resistor 355 is disposed within third tube 360. In one embodiment, acoustic resistor 355 is disposed near third opening 350. In one embodiment, acoustic resistor 390 is disposed within fourth tube 380. In one embodiment, acoustic resistor 390 is disposed near fourth opening 385.

Microphone element 335 separates first cavity 330 and second cavity 340. Microphone element 335 is in electrical communication with electric circuit 370 through junction 371. Microphone element 368 separates third cavity 365 and fourth cavity 370. Microphone element 368 is in electrical communication with circuit 370 through junction 372. Electrical circuit 370 combines electrical signals from first microphone element 335 and second microphone element 368. In one embodiment, electrical circuit 370 filters or otherwise modifies the signals received from the first and second microphone elements 335, 368. Electrical circuit 370 generates output signal 375.

Figure 4:
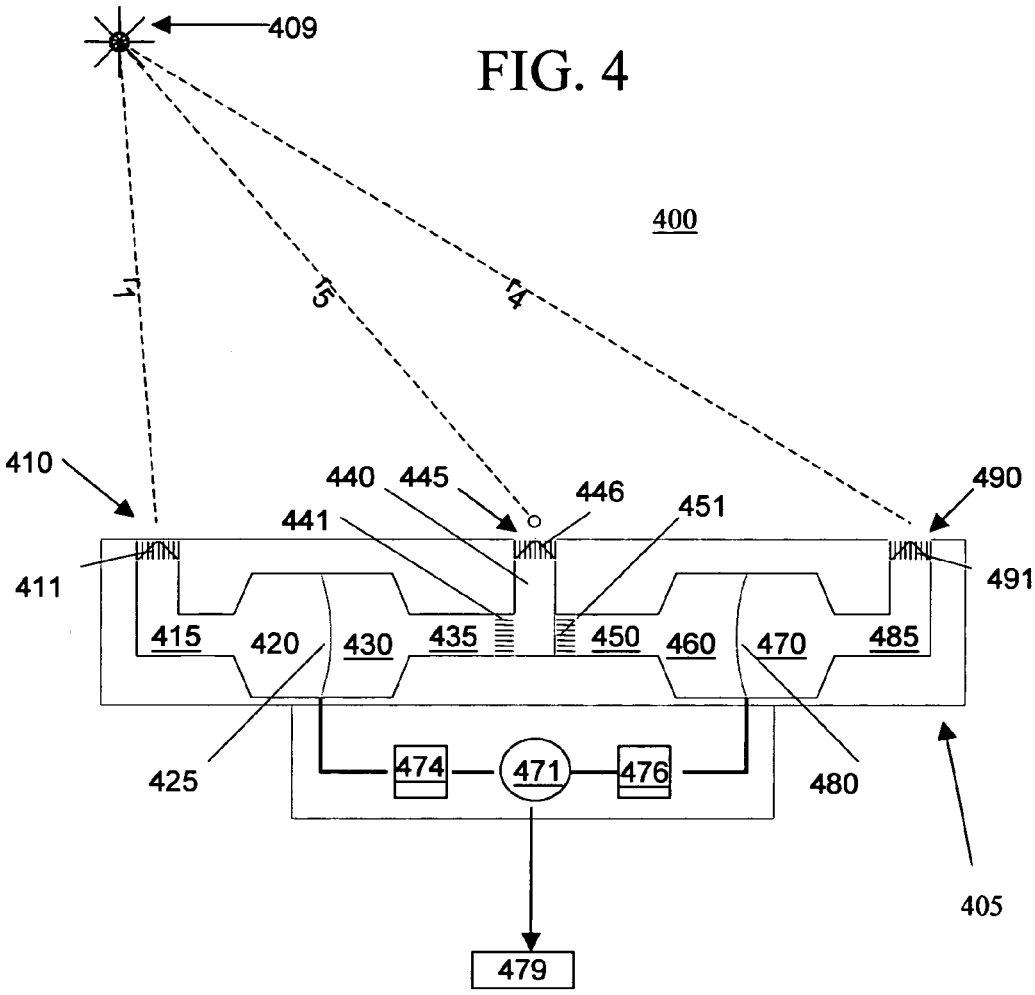
FIG. 4 illustrates one embodiment of a microphone assembly in accordance with one aspect of the invention.

FIG. 4 illustrates one embodiment of a microphone assembly 400 in accordance with the invention. Sound source 409 emits sound waves r1, r4, and r5 received at housing 405. Housing 405 includes first opening 410, second opening 445, and third opening 490.

First opening 410 communicates with first tube 415 which communicates with first cavity 420. In one embodiment, an acoustic resistor 411 is disposed in first tube 415. In one embodiment, acoustic resistor 411 is disposed near first opening 410. Second opening 445 communicates with second tube 440. In one embodiment, acoustic resistor 446 is disposed in second tube 440. In one embodiment, acoustic resistor 446 is disposed near second opening 445. Second tube 440 communicates with third tube 435 and fourth tube 450. In one embodiment, third tube 435 includes acoustic resistor 441. In one embodiment, fourth tube 450 includes acoustic resistor 451. Third tube 435 communicates with second cavity 430. Fourth tube 450 communicates with third cavity 460. Third opening 490 communicates with fifth tube 485. In one embodiment, acoustic resistor 491 is disposed in fifth tube 485. In one embodiment, acoustic resistor 491 is disposed near third opening 490. Fifth tube 485 communicates with fourth cavity 470.

Microphone element 425 separates first cavity 420 and second cavity 430 and is in electronic communication with electronic circuit 471 via junction 474. Microphone element 480 separates third cavity 460 and fourth cavity 470 and is electronic communication with electronic circuit 471 via junction 476. Electronic circuit 471 generates signal 479 based on the inputs from microphone element 425 and microphone element 480. In one embodiment, circuit 471 functions to filter or otherwise modify the electric signals from microphone element 425 and microphone element 480.

FIG. 5 illustrates one embodiment of a microphone assembly 500 in accordance with one aspect of the invention. Microphone assembly 500 includes housing 505 that receives sound waves r1, r2, r3, and r4 from sound source 509.

Housing 505 includes first opening 515, second opening 520, third opening 570, and fourth opening 560. First opening 515 communicates with first tube 525, second opening 520 communicates with second tube 535, third opening 570 communicates with third tube 545, and fourth opening 560 communicates with fourth tube 555. In one embodiment, acoustic resistors 516, 521, 571, and 561 are disposed in first, second, third, and fourth tubes 525, 535, 545, and 555 respectively. In one embodiment, acoustic resistors 516, 521, 571, and 561 are disposed near first, second, third, and fourth openings 515, 520, 570, and 560 respectively.

First tube 525 and fourth tube 555 communicate with first cavity 540. Second tube 535 and third tube 545 communicate with second cavity 530. First cavity 540 and second cavity 530 are separated by microphone element 560. Microphone element 560 generates electronic signals (not shown) in response to pressure differentials acting on the microphone element 560.

Figure 5A:
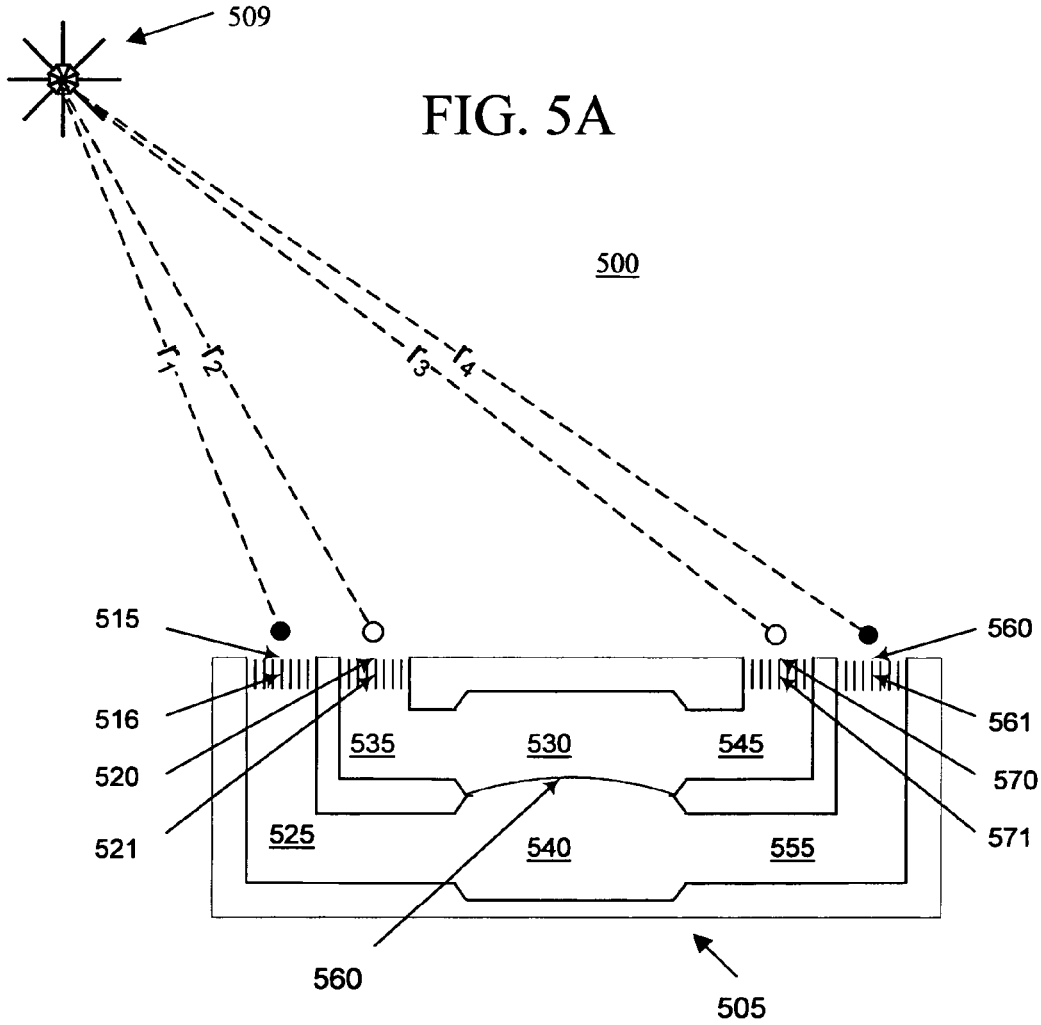
FIG. 5A illustrates one embodiment of a microphone assembly in accordance with one aspect of the invention.
Figure 5B:
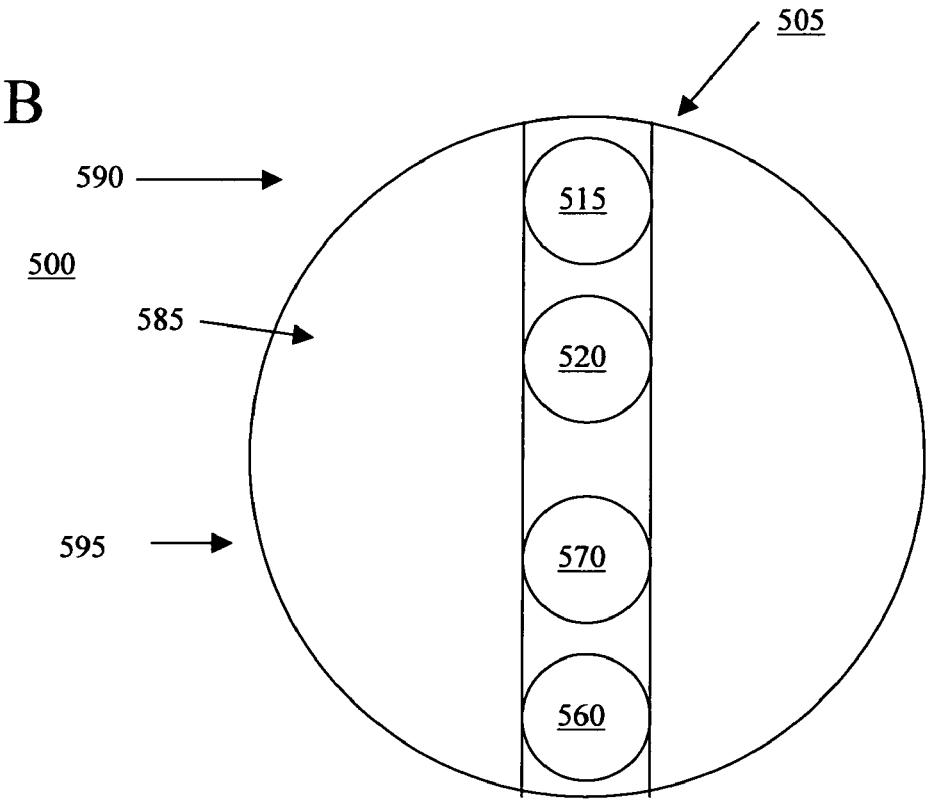
FIG. 5B illustrates a top view of the microphone assembly of FIG. 5A in accordance with one aspect of the invention.

FIG. 5B illustrates a top view of the microphone assembly depicted in FIG. 5A. As shown in FIG. 5B, microphone assembly housing 505 includes a sound reception face 585 including a first end 590 and a second end 595, the first end 590 opposed to the second end 595. First opening 515 is located near first end 590 and fourth opening 560 is located near second end 595. Second opening 520 and third opening 570 are between first opening 515 and fourth opening 560, with second opening 520 between first opening 515 and third opening 570 and third opening 570 between second opening 520 and fourth opening 560. The first, second, third and fourth openings 515, 520, 570, and 560 define a straight line 595 along the sound reception face, in one embodiment. Other embodiments of the invention include alternate arrangements of a plurality of openings on a sound reception face, such as opposing, quincunx, or others.

The acoustic inductance, capacitance, and resistance of microphone assemblies 200, 300, 400, and 500 can be tuned or adjusted by controlling the dimensions of the openings, tubes, cavities, and acoustic resistors. In one embodiment, the adjustments are made as a design choice, while in other embodiments, the adjustments are controlled as a result of electronic adjustments applied to change the effective dimensions of the openings, tubes, or cavities. For example, the length of the tubes affects the acoustic inductance of the microphone assembly. In another example, the volume of the cavities controls the acoustic capacitance of the microphone assembly.

Figure 6:
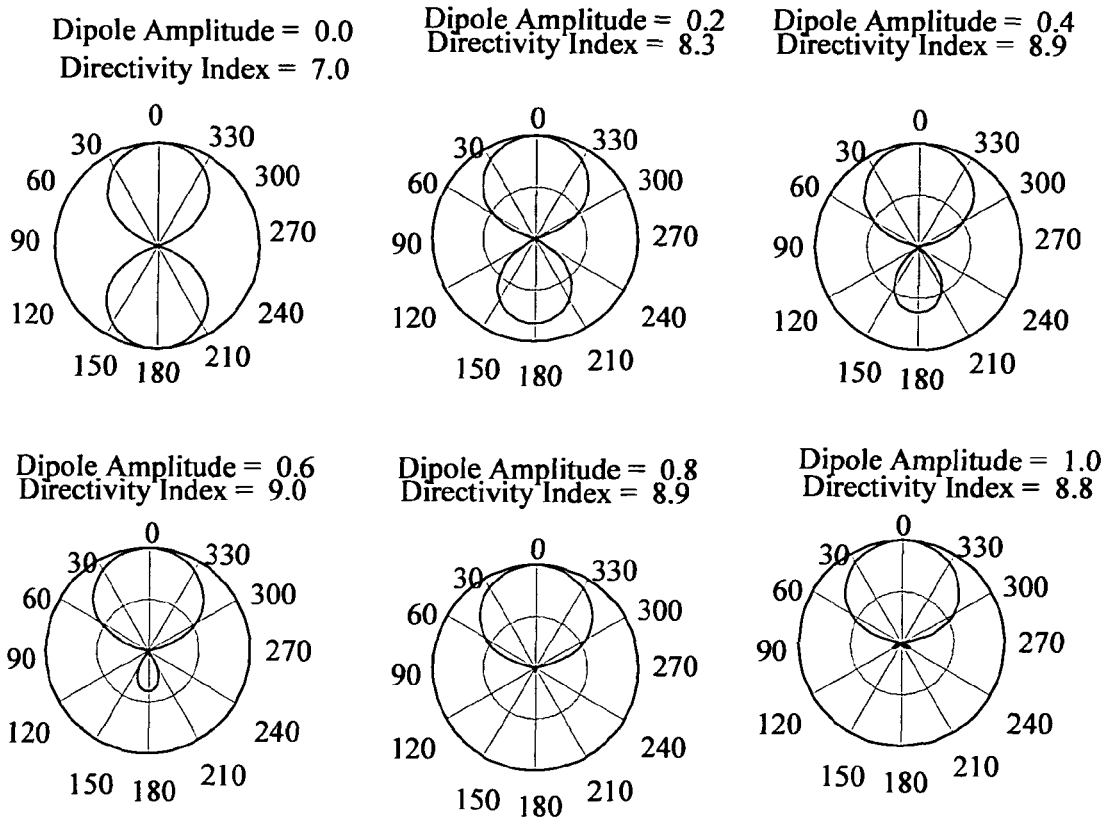
FIG. 6 illustrates directivity indices for microphone assemblies in accordance with various embodiments of the invention.

FIG. 6 illustrates exemplary directivity indices for microphone assemblies, such as microphone assemblies 200, 300, 400, or 500, in accordance with another aspect of the invention. As shown, microphone assemblies 200, 300, 400, or 500 can achieve a DI of up to 9 dB.

Figure 7:
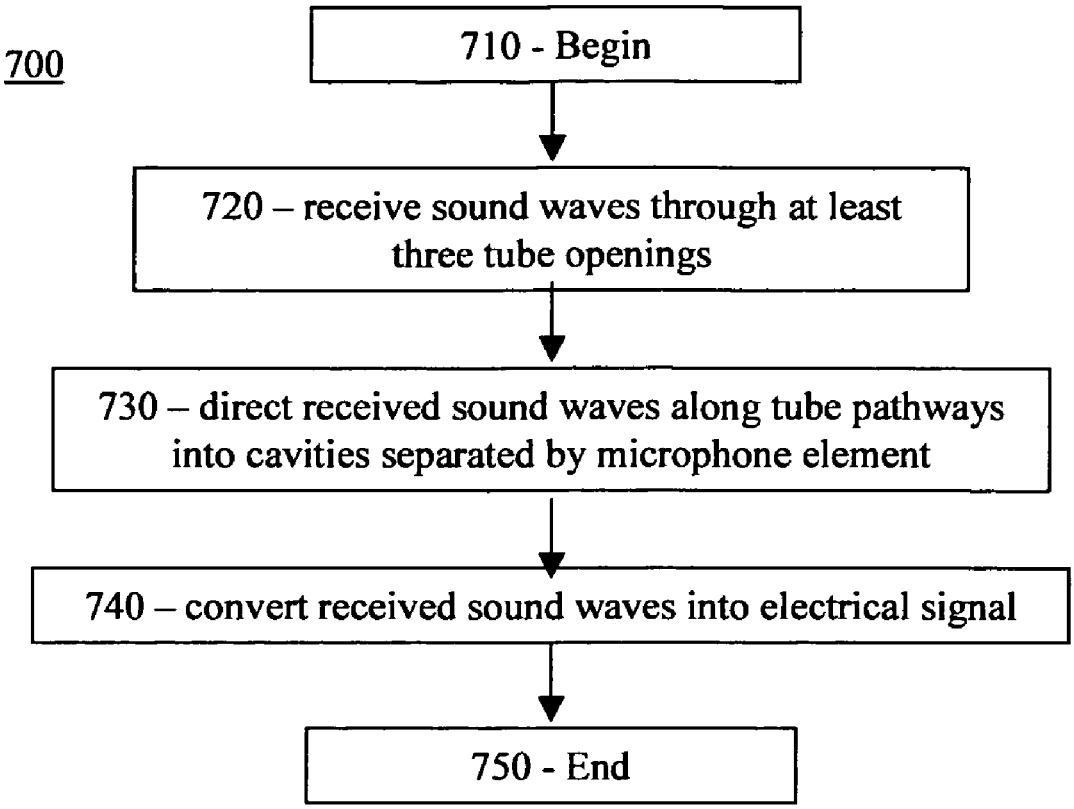
FIG. 7 illustrates one embodiment of a method for converting sound waves into an electrical signal, in accordance with one aspect of the invention.

FIG. 7 illustrates one embodiment of a method 700 for converting sound waves into an electrical signal, in accordance with one aspect of the invention. Method 700 begins at 710.

Sound waves are received through at least three tube openings at step 720. In one embodiment, the at least three tube openings are implemented as in any of the openings disclosed with respect to FIGS. 2, 3, 4, or 5. The sound waves are emitted by any sound source, such as sources 210, 310, 409, or 509. The received sound waves are directed along tube pathways into at least a first cavity and a second cavity to a microphone separating the first and second cavities at step 730. The tube pathways can be implemented as any of the tubes disclosed above with respect to FIGS. 2, 3, 4, or 5. The first and second cavities can be implemented as any of the cavities disclosed above with respect to FIGS. 2, 3, 4, or 5. The microphone can be implemented as any appropriate microphone element, such as the microphone elements disclosed above with respect to FIGS. 2, 3, 4, or 5. The microphone can be omnidirectional, bidirectional or feature any other directivity pattern.

The received sound is converted to an electrical signal with the microphone at step 740. Conversion of the received sound to an electrical signal is implemented by any appropriate means. The electrical signal may be processed using appropriate electronic circuits, such as filters, amplifiers, or the like, or the signal may be sent to a destination without additional electronic modification. Method 700 ends at 750.

Any of the acoustic resistors disclosed herein can be any acoustic resistor known to those of skill in the art, including foam, cloth and screens.

The present invention may be embodied in other specific forms without departing from the spirit or essential characteristics. The described embodiments are to be considered in all respects only as illustrative and not restrictive. Those of ordinary skill in the art will readily recognize that specific time intervals or time spans other than those that are mentioned herein are contemplated, and would be able to implement such an alternate implementation without undue experimentation.

What is claimed is:

1. A microphone assembly comprising:

a housing including a plurality of openings, a plurality of cavities, and a plurality of tubes, the plurality of openings including at least first, second, and third openings and the plurality of cavities including at least first and second enlarged cavities each of which is in communication with at least one of the first, second, and third openings via the tubes; and at least one microphone element separating the first and second cavities, wherein sound waves are received in the first, second, and third tubes and directed into the cavities and received by the microphone element, and wherein at least one of the cavities is connected via one or more of the tubes to a single one of the openings.

2. The assembly of claim 1 wherein the plurality of tubes includes first, second, and third tubes, and wherein the first tube receives sound through the first opening, the second tube receives sound through the second opening, and the third tube receives sound through the third opening.

3. The assembly of claim 1 wherein the microphone element is selected from the group consisting of a bidirectional microphone and a unidirectional microphone.

4. The assembly of claim 1 wherein the housing includes a sound reception face, wherein the openings are located in the sound reception face, and wherein the openings define a straight line.

5. The assembly of claim 4 wherein the tubes include an acoustic resistor disposed near the openings.

6. The assembly of claim 4 wherein the face has a first end and a second end, and wherein the first opening is near the first end and the third opening is near the second end.

7. The assembly of claim 4 wherein the openings define a straight line along the sound reception face.

8. The assembly of claim 1 wherein the assembly comprises a directivity index of greater than or equal to 6 decibels.

* * * * *